US006745812B1

(12) United States Patent
Liu et al.

(10) Patent No.: US 6,745,812 B1
(45) Date of Patent: Jun. 8, 2004

(54) HYPOCYCLOID DRIVE DEVICE FOR ADJUSTING SLAT ANGLES FOR A VENETIAN BLIND

(76) Inventors: Tai-Ping Liu, No. 15, Alley 8, Lane 3, Kuo-Chi St., Lung-Ching Hsiang, Taichung Hsien (TW); Patrick James McGrath, 9F, No. 86-2, Jungan St., Junghe City, Taipei Hsien (TW); Wasyl R. Bodnar, 3342 Warwood Rd., Lakewood, CA (US) 90712-3750

( * ) Notice: Subject to any disclaimer, the term of this patent is extended or adjusted under 35 U.S.C. 154(b) by 0 days.

(21) Appl. No.: 10/373,347

(22) Filed: Feb. 24, 2003

(51) Int. Cl.[7] ..... E06B 9/38
(52) U.S. Cl. ..... 160/177 R; 475/178
(58) Field of Search ..... 160/319, 321, 160/176.1 R, 177 R, 177 V, 168.1 R, 173 R; 475/178

(56) References Cited

U.S. PATENT DOCUMENTS 2,334,132 A * 11/1943 Sherwood ..... 160/176.1 R
4,177,695 A * 12/1979 Grove ..... 475/177
4,657,060 A * 4/1987 Kaucic ..... 160/168.1 V
4,834,163 A * 5/1989 Dickstein ..... 160/176.1 R
5,123,883 A * 6/1992 Fukaya ..... 475/178
5,137,073 A * 8/1992 Huang ..... 160/321
5,484,345 A * 1/1996 Fukaya ..... 475/162
5,803,148 A * 9/1998 Madsen ..... 160/176.1 R
6,148,893 A * 11/2000 Cadorette ..... 160/176.1 P

FOREIGN PATENT DOCUMENTS

FR 2666129 * 8/1990

* cited by examiner

*Primary Examiner*—Blair M. Johnson
(74) *Attorney, Agent, or Firm*—Dellett & Walters

(57) ABSTRACT

A hypocycloid drive device for adjusting slat angles of a venetian blind includes a housing, a roller, a hypocycloid drive reducer, a tilt cord and a tilt rod. The roller is rotatably mounted in the housing and is rotated by pulling the tilt cord. The hypocycloid drive reducer is coupled to the roller and is used to reduce an angular speed of and rotate the tilt rod. The tilt rod is adapted to change slat angles of the venetian blind. Consequently, volume of the hypocycloid drive device is minimized to accommodate convenient installation of the hypocycloid drive device.

7 Claims, 7 Drawing Sheets

HYPOCYCLOID DRIVE DEVICE FOR ADJUSTING SLAT ANGLES FOR A VENETIAN BLIND

BACKGROUND OF THE INVENTION

1. Field of the Invention

The present invention relates to a hypocycloid drive device, and more particularly to a hypocycloid drive device powered by pulling a tilt cord to adjust slat angles for a venetian blind.

2. Description of Related Art

Venetian blinds are made of slats suspended between parallel ribbons and are hung over windows. A user can adjust the slat angle to regulate the light transmitted into a room. A conventional drive device for adjusting the slat angle comprises a worm gear, a worm and a tilt cord. The worm is adapted to couple to an end of a tilt rod that will change the slat angle. The worm gear is meshed with the worm and is operated by the tilt cord. When a user pulls the tilt cord, the tilt cord rotates the worm gear, and the worm gear rotates the worm. A tilt rod rotates with the worm to change the slat angle of a venetian blind.

The elements of the conventional drive device are arranged and assembled in at least two axial directions. Specifically, the worm and the worm gear are not arranged co-axially. Such a structure of the drive device occupies a large volume.

The drive device and the tilt rod are installed in a head rail of the venetian blind. Therefore, the head rail of the venetian blind also must be large enough to hold the conventional drive device. The enlarged head rail of the venetian blind will be inconvenient to mount or decorate.

To overcome the shortcomings, the present invention provides a hypocycloid drive device for adjusting the slat angle in a venetian blind to mitigate or obviate the aforementioned problems.

SUMMARY OF THE INVENTION

The main objective of the invention is to reduce the size of the drive device for adjusting slat angles in a venetian blind.

Another objective of the invention is to reduce the size of a venetian blind head rail.

The foregoing objectives are achieved by using a hypocycloid drive device to adjust the slat angle of the venetian blind.

Other objectives, advantages and novel features of the invention will become more apparent from the following detailed description when taken in conjunction with the accompanying drawings.

DETAILED DESCRIPTION OF PREFERRED EMBODIMENT

Figure 1:
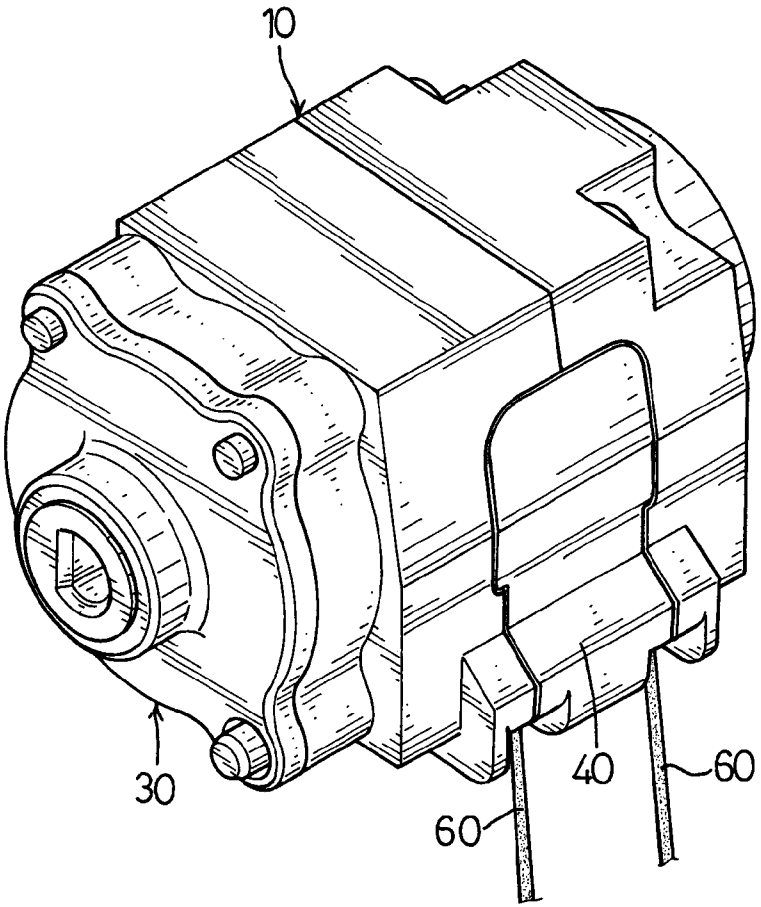
FIG. 1 is a perspective view of a hypocycloid drive device for adjusting slat angles of a venetian blind in accordance with the present invention.
Figure 2:
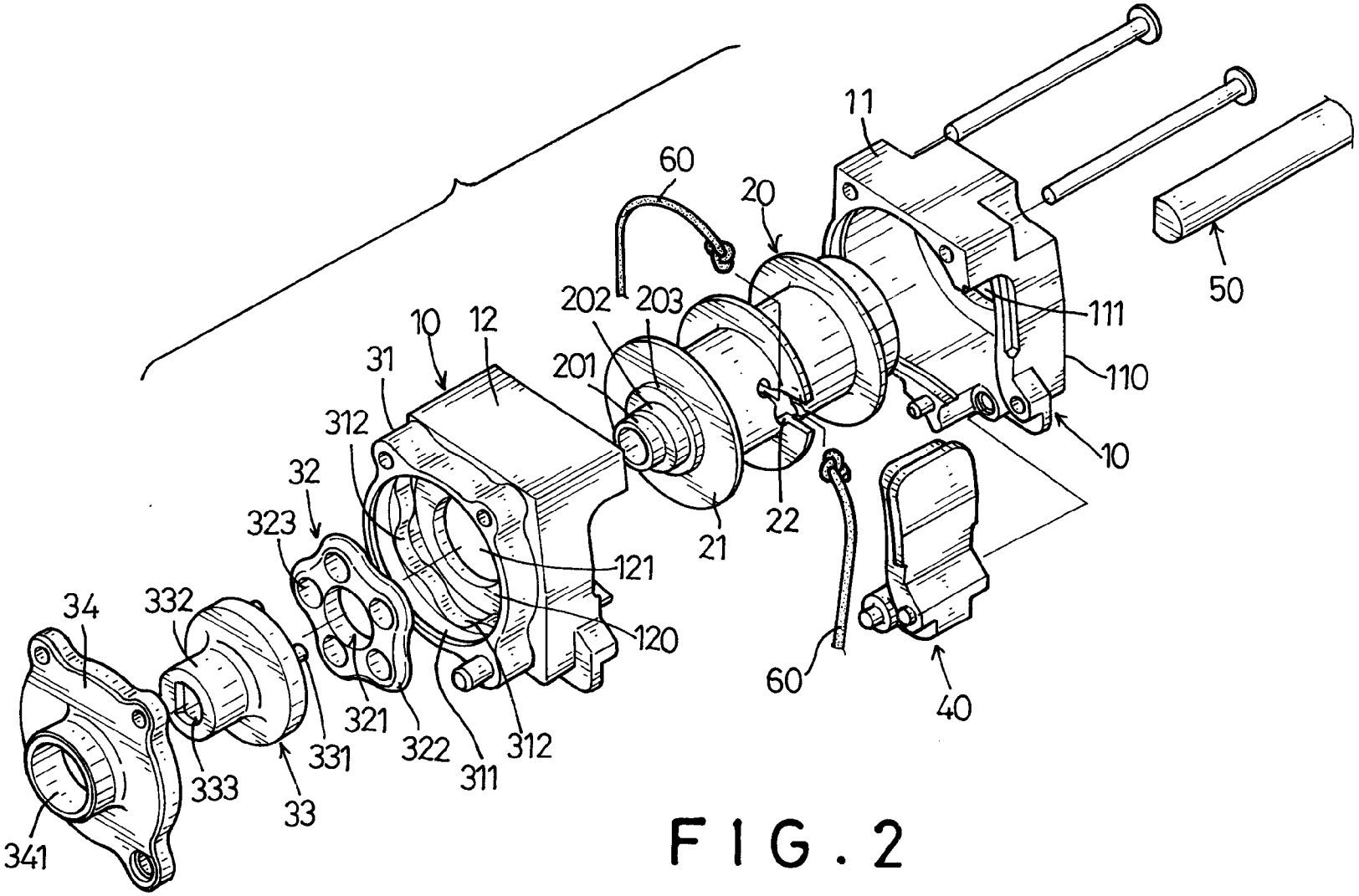
FIG. 2 is an exploded perspective view of the hypocycloid drive device in FIG. 1.

With reference to FIGS. 1 and 2, a hypocycloid drive device (not numbered) for adjusting slat angle of a venetian blind comprises a housing (10), a roller (20), a hypocycloid drive reducer (30), a cord guide (40), a tilt rod (50) and a cord (60). The housing (10) comprises an inside body half (11) and an outside body half (12) and has a front (not numbered). The inside body half (11) has an inside end (110) and an internal recess (not numbered). An inside axial hole (111) is defined through the inside end (110) of the inside body half (11) The outside body half (12) has an outside end (120) and an internal recess (not shown). The internal recess in the outside body half (12) corresponds to the internal recess in the inside body half (11) to form an internal body cavity (not numbered). An outside axial hole (121) is defined through the outside end (120) of the outside body half (12).

Figure 3:
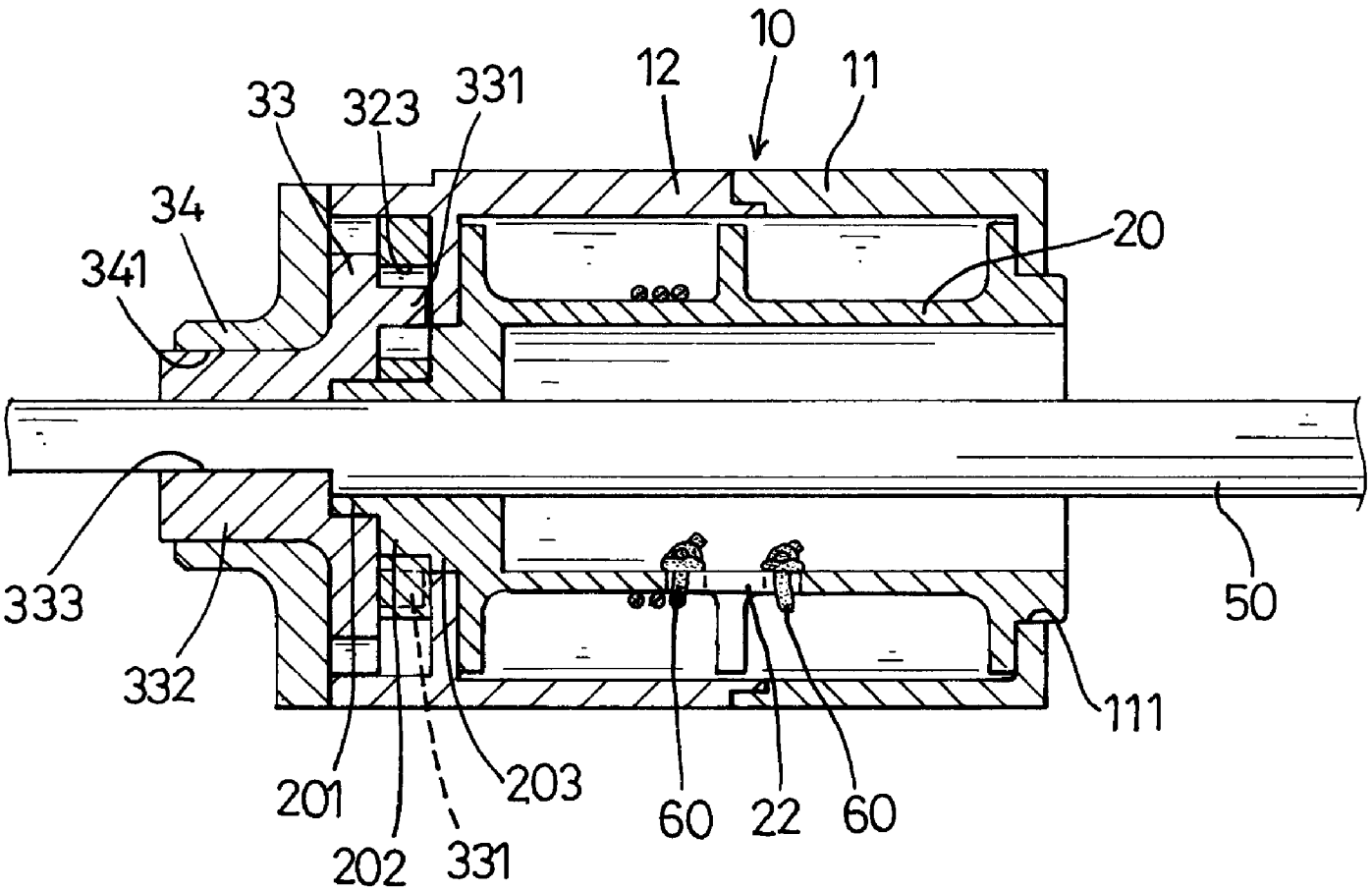
FIG. 3 is a cross sectional front plan view of the hypocycloid drive device in FIG. 1.
Figure 4:
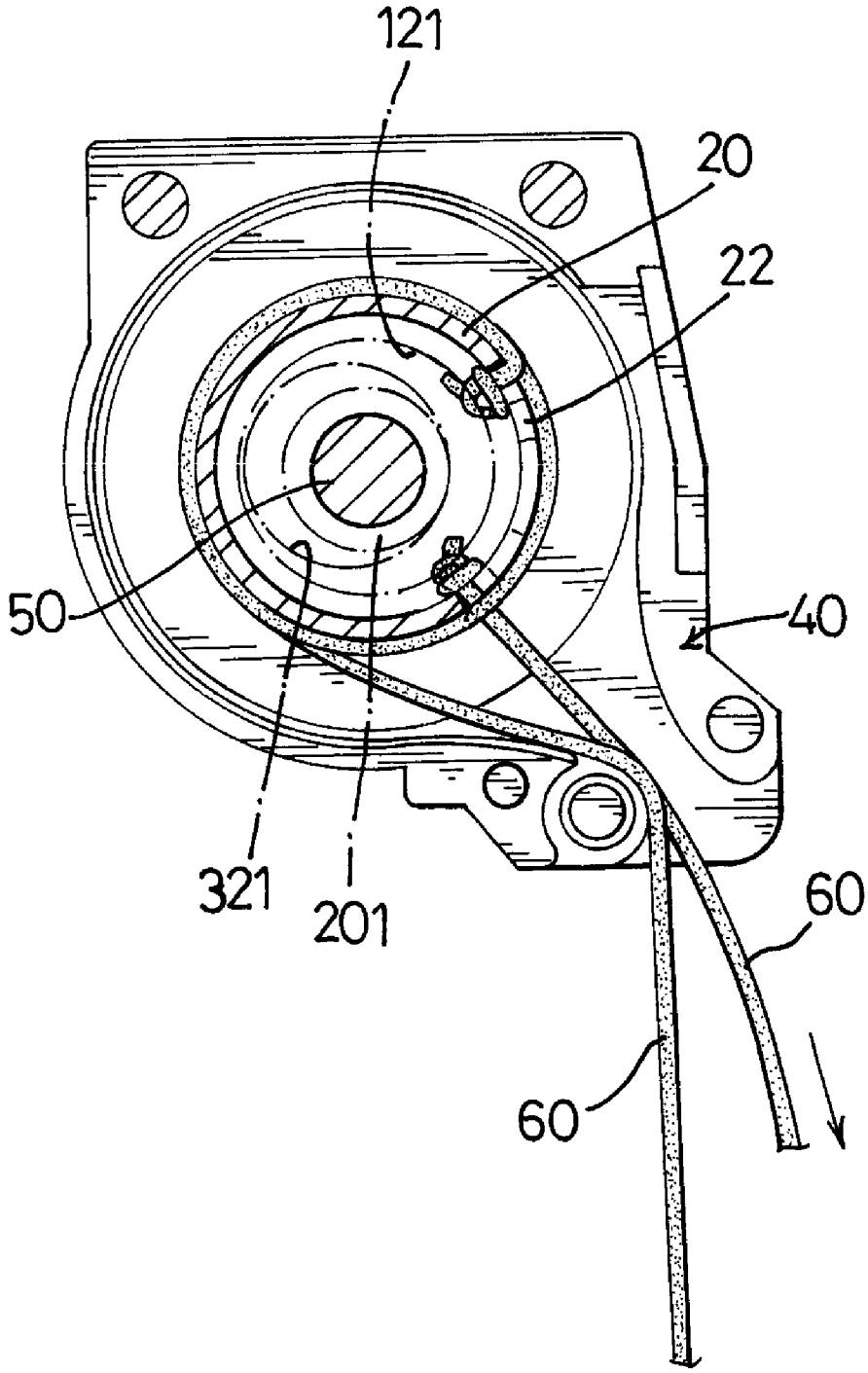
FIG. 4 is an operational side plan view in partial section of the hypocycloid drive device in FIG. 1 with a tilt cord having been pulled outside of a housing to rotate a roller of the drive device in a clockwise direction.

With reference to FIGS. 2 and 3, the roller (20) is rotatably mounted in the internal body cavity of the housing (10), is a hollow cylinder and has an exterior surface (not numbered), an axis (not shown), an outside end (not numbered) and an inside end (not numbered). The outside end of the roller (20) faces the outside end (120) of the housing (10) and has a protruding outer axial journal (201), eccentric member (202) and an inner axial journal (203). The protruding inner axial journal (203) corresponds to and is rotatably mounted in the outside axial hole (121) in the outside end (120) of the housing (10). The eccentric member (202) and the outer axial journal (201) extend out of the outside axial hole (121) in the outside end (120) of the housing (10). The eccentric member (202) is circular and is offset from the axis of the roller (20) that causes it to be eccentric. The inside end of the roller (20) faces the inside end of the housing (10) and has a protruding axial journal (not numbered). The protruding axial journal on the inside end of the roller (20) corresponds to and is rotatably mounted in the inside axial hole (111) in the inside end (110) of the housing (10). Three radial flanges (21) divide the exterior surface of the roller (20) into two equal parts (not numbered). A locking hole (22) is defined through the exterior surface of the roller (20) to hold opposite ends (not numbered) of the tilt cord (60) in respective parts of the exterior surface. Each end of the tilt cord (60) has a stop (not numbered), such as a knot, and the stop is respectively held in the locking hole (22). The tilt cord (60) is wrapped around the respective parts of the exterior surface of the roller (20) between adjacent radial flanges (21) before the hypocycloid drive device is operated. The wrapped cord (60) will be pulled outside of the housing (10) to rotate the roller (20), and the rotation of the roller (20) will simultaneously wrap a portion of the cord (60) around the other part of the exterior surface of the roller (20).

The cord guide (40) is pivotally mounted in the front of the housing (10) and has two bottom openings (not numbered) that respectively allow the two ends of the tilt cord (60) to pass through into the housing (10) to be held in the locking hole (22). The cord guide (40) also allows the tilt cord (60) to be pulled inside or outside of the housing (10).

The hypocycloid drive reducer (30) is mounted at the outside end (120) of the housing (10) and has a bracket (31), a hypocycloid disk (32), a correction wheel (33) and an end cap (34). The bracket (31) is hollow and has a through hole (not numbered) longitudinally and co-axially defined through the bracket (31). The through hole in the bracket (31) has an inner surface (311), and the eccentric member (202) and the outer axial journal (201) on the outside end of the roller (20) pass through the through hole in the bracket (31). Stationary lobes (312) are formed radially on the inner surface (311) of the through hole to provide stationary surfaces against which a force generated in the hypocycloid disk (32) press.

The hypocycloid disk (32) is mounted around the eccentric member (202) and is rotatably mounted in the through hole in the bracket (31). The hypocycloid disk (32) has a central hole (321), a center (not numbered)and an outside edge (not numbered). The eccentric member (202) on the outside end of the roller (20) is slidably mounted in the central hole (321) in the hypocycloid disk (32). Rotation of the roller (20) will rotate the center of the hypocycloid disk (32) around the axis of the roller (20). Actuating lobes (322) are radially defined at the outside edge of the hypocycloid disk (32) and engage the stationary lobes (312) in the bracket (31) as the hypocycloid disk (32) rotates. The hypocycloid disk (32) has a different number of actuating lobes (322) than the bracket (31) has stationary lobes (312). The number of the actuating lobes (322) on the hypocycloid disk (32) is one less than the stationary lobes (312) in the bracket (31). The numbers of the lobes (322, 312) determines a reduction ratio of the hypocycloid drive reducer (30). Furthermore, output-to-input is also increased by this amount, enabling input small forces to create useful output torques. A drive hole (323) corresponding to each actuating lobe (322) with an inner diameter (not numbered) is defined through the hypocycloid disk (32) between the corresponding actuating lobe (322) and the central hole (321) to connect the hypocycloid disk (32) to the correction wheel (33).

The correction wheel (33) is coupled to and rotated by the hypocycloid disk (32). The correction wheel (33) has an inner end (not numbered) and an elongated end (332) opposite to the inner end. The inner end of the correction wheel (33) faces the hypocycloid disk (32), and an axial recess (not numbered) corresponding to the inner axial journal (201) on the outside end of the roller (20) is defined in the inner end. The inner axial journal (201) on the outside end of the roller (20) is rotatably mounted in the axial recess. A driven stub (331) corresponding to each drive hole (323) on the hypocycloid disk (32) has an outer diameter (not numbered) and is formed on the inner end of the correction wheel (33). Each driven stub (331) is held in one drive hole (323) in the hypocycloid disk (32). The outer diameter of each stub (331) is smaller than the inner diameter of each drive hole (323), preferably equal to the inner diameter of the drive holes (323) minus twice the offset of the eccentric member (202) such that the driven stubs (331) will be slidably held in the drive hole (323) in the hypocycloid disk (32) at any given time.

An axial keyed hole (333) is defined through the elongated end (332) of the correction wheel (33) and communicates with the axial recess in the inner end of the correction wheel (33). The tilt rod (50) has a keyed end (not numbered) that is mounted in and driven by the keyed hole (333).

The end cap (34) has an axial hole (341), is attached to the bracket (31) and holds the hypocycloid disk (32) and the correction wheel (33) in the bracket (31). The elongated end (332) of the correction wheel (33) is rotatably mounted in the axial hole (341) in the end cap (34) such that the hypocycloid disk (32) and the correction wheel (33) are rotatably mounted in the bracket (31).

The tilt rod (50) is adapted to be rotated to change the slat angle of a Venetian blind or any of other applications requiring angular movement by an output shaft.

With reference to FIGS. 4 to 7, pulling the tilt cord (60) wrapped around the roller (20) outside of the housing (10) will rotate the roller (20) and simultaneously wrap a portion of the tilt cord (60) around the exterior surface of the roller (20). The radial flanges (21) keep the tilt cord (60) from fouling on the roller (20). The roller (20) rotates the eccentric member (202) and the center of the hypocycloid disk (32). As the hypocycloid disk (32) orbits the axis of the roller (20), different actuating lobes (322) of the hypocycloid disk (32) encounter the stationary lobes (312) in the bracket (31). Since the number of the actuating lobes (322) on the hypocycloid disk (32) is one less than the number of the stationary lobes (312) in the bracket (31), Each actuating lobe (322) of the hypocycloid disk (32) meshes with one stationary lobe (312) in the bracket (31) and exerts an angular force on the stationary lobe (312) in the bracket (31) and causes the hypocycloid disk (32) to rotate. During the rotation of the hypocycloid disk (32), the net result is that the hypocycloid disk (320) rotates 1/M rotations in the opposite direction of the input rotation provided by the roller (20). Where the number of the actuating lobes (322) on the hypocycloid disk (32) is represented by the variable M and the number of the stationary lobes (312) in the bracket (31) is represented by the number N. Where M is one less than the number N. Each time one actuating lobe (322) of the hypocycloid disk (32) abuts a stationary lobe (312) in the bracket (31), the hypocycloid disk (32) is rotated a fraction of a revolution around an axis of rotation (not shown). When the hypocycloid disk (32) completes a full orbit around the axis of the roller (20), the hypocycloid disk (32) has rotated a fraction of a complete revolution about the axis of rotation.

Generally, the fraction of the complete revolution of the hypocycloid disk (32) about the axis of rotation is calculated as a function of the numbers N and M. With such an arrangement, a speed reduction ratio R can be calculated as follows:

$$R=(\text{input rotation})/(\text{output rotation})=M/(M-N)$$

Figure 5:
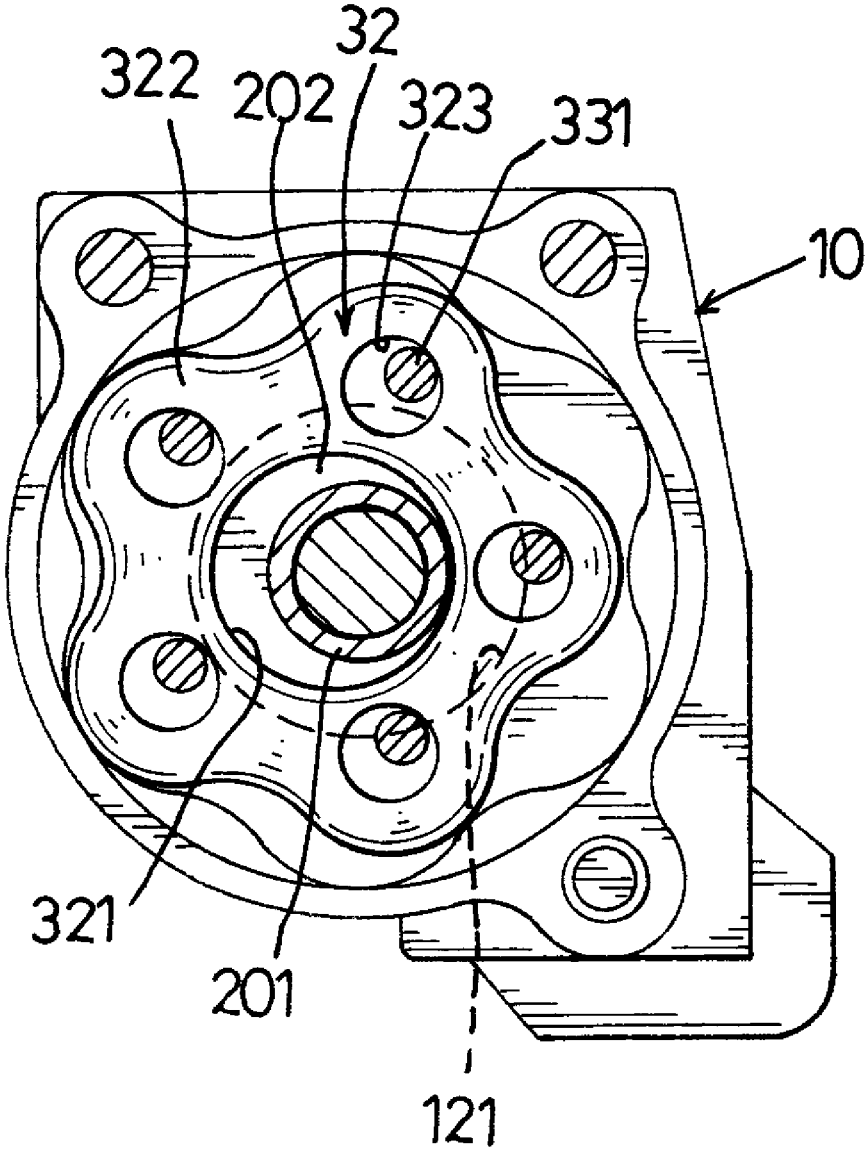
FIG. 5 is an operational cross sectional side plan view of the hypocycloid drive device in FIG. 4 showing the rotation of a hypocycloid disk.
Figure 6:
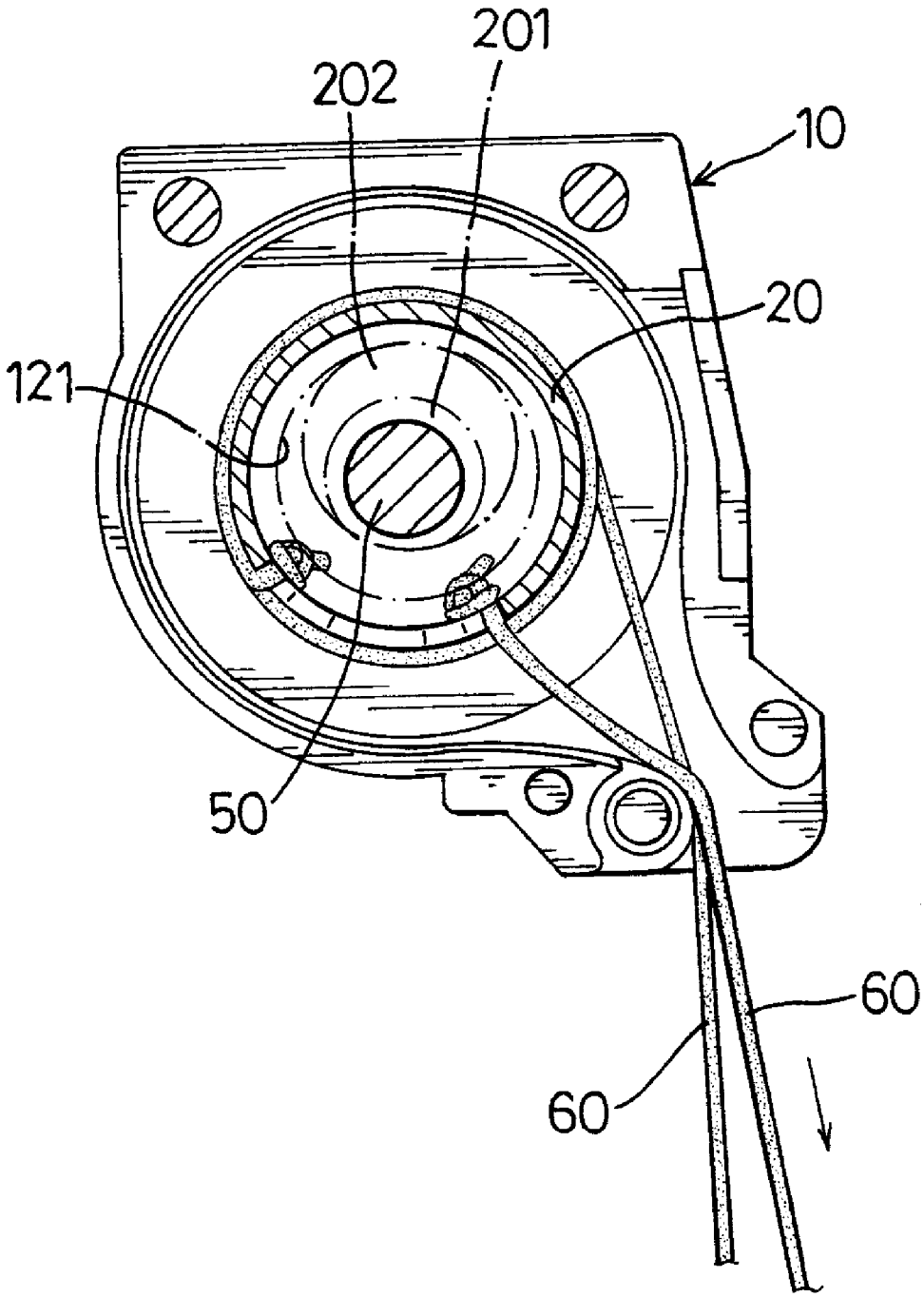
FIG. 6 is an operational side plan view in partial section of the hypocycloid drive device in FIG. 1 with a tilt cord having been pulled outside of a housing to rotate a roller in a counter-clockwise direction.
Figure 7:
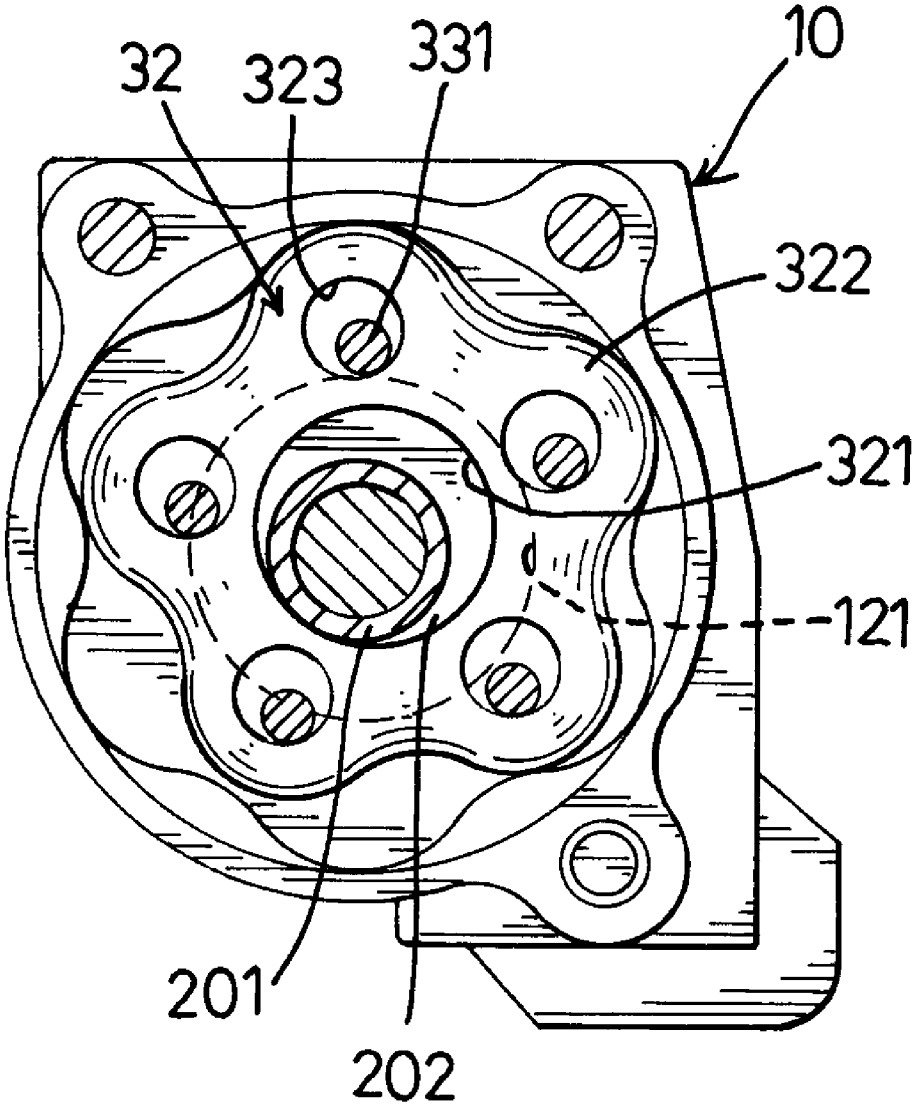
FIG. 7 is an operational cross sectional side plan view of the hypocycloid drive device in FIG. 6 showing the rotation of a hypocycloid disk.

Consequently, in the FIGS. 2, 5 and 7, the number N is equal to 6, and the number M is equal to 5. The resultant speed reduction ratio R is equal to −5. The negative sign signifies that the input and the output rotations are in opposite directions. In other words, the center of the hypocycloid disk (32) is rotated around the axis of the roller (20), which is regarded as an input rotation, and the correction wheel (33) rotates around the axis of rotation of the hypocycloid disk (32) in the opposite direction, which is regarded as an output rotation. Thereafter, the correction wheel (33) rotates the tilt rod (50) in a direction opposite to the rotation of the roller (20) at one-fifth the angular movement of the center of the hypocycloid disk (32) around the axis of the roller (20).

With reference to FIGS. 1 and 3, the rotating elements of the hypocycloid drive device, the roller (20), the hypocycloid disk (32), the correction wheel (33) and the tilt rod (50), are axially parallel and nearly coaxial. Therefore, volume of the hypocycloid drive device is minimized and is significantly less than a conventional drive device. The small volume of the hypocycloid drive device allows a head rail of a venetian blind in which the hypocycloid drive device is mounted to be smaller than a conventional head rail.

Furthermore, the hypocycloid drive reducer (30) reduces the revolution of roller (20) so that the revolution of the tilt rod (50) will rotate in small increments. The tilt rod (50) will rotate the tilt rod (50) to precisely change the slat angle of the venetian blind to meet a user's lighting requirement.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hypocycloid drive device for adjusting slat angles of a venetian blind, the hypocycloid drive device comprising:

a housing having an internal body cavity, a front, an outside end and an inside end, an inside axial hole defined in the inside end, an outside axial hole defined in the outside end of the housing;

a roller rotatably mounted in the internal body cavity of the housing and the roller having an axis;

an exterior surface;

an inside end having a protruding axial journal and the protruding axial journal rotatably held in the inside axial hole in the inside end of the housing; and an outside end having a protruding outer axial journal, an eccentric member and an inner axial journal, the protruding outer axial journal corresponding to and rotatably mounted in the outside axial hole in the outside end of the housing, and the eccentric member and the inner axial journal extending out of the outside axial hole, where the eccentric member is offset from the axis of the roller;

a tilt cord having two opposite ends attached to the exterior surface of the roller and wrapped around the exterior surface of the roller before the drive device is operated;

a hypocycloid drive reducer attached to the outside end of the housing and coupled to the roller, and the hypocycloid drive reducer comprising a hollow bracket having a through hole axially defined through the bracket, the through hole having an inner surface and N number of stationary lobes radially protruding from the inner surface of the through hole in the bracket;

a hypocycloid disk having a central hole, a center and an outside edge, mounted on the eccentric member on the outside end of the roller and rotatably mounted in the through hole in the bracket, the eccentric member slidably held in the central hole of the hypocycloid disk and the hypocycloid disk further having M number of actuating lobes radially defined at the outside edge of the hypocycloid disk to abut the stationary lobes on the bracket; and multiple drive holes each having an inner diameter defined through the hypocycloid disk between the actuating lobes and the central hole of the hypocycloid disk respectively corresponding to the actuating lobes;

a correction wheel coupled to the hypocycloid disk and having an inner end, an elongated end, multiple driven stubs each having an outer diameter radially formed at the inner end, each driven stub held in one of the drive holes in the hypocycloid disk, an axial recess defined in the inner end with the inner axial journal on the outside end of the roller rotatably mounted in the axial recess and a keyed hole longitudinally defined through the elongated end in the correction wheel and communicating with axial recess in the inner end; and an end cap attached to the bracket to hold the hypocycloid disk and the correction wheel in the bracket and having an axial hole, where the elongated end of the correction wheel is rotatably mounted in the axial hole in the end cap; and a tilt rod having a keyed end attached to the correction wheel with the keyed end of the tilt rod held in the keyed hole in the correction wheel and adapted to change slat angles of a venetian blind;

wherein the number M is one less than the number N, and the outer diameter of each driven stub of the correction wheel is smaller than the inner diameter of each drive hole in the hypocycloid disk so that each driven stub is slidably held in one of the drive holes.

2. The hypocycloid drive device as claimed in claim 1, wherein the roller is a hollow cylinder;

the tilt rod rotatably impasses through the roller and the keyed end corresponding to the keyed hole in the correction wheel, the keyed end of the tilt rod extends out of the roller and fits in the keyed hole in the correction wheel.

3. The hypocycloid drive device as claimed in claim 1, wherein three radial flanges are equidistantly formed on the exterior surface of the roller to divide the exterior surface of the roller into two respective parts to prevent the tilt cord from fouling on the roller; and a locking hole is defined through the exterior surface of the roller to hold the two ends of the tilt cord;

wherein a portion of the tilt cord wraps around each respective part of the exterior surface of the roller between two adjacent radial flanges.

4. The hypocycloid drive device as claimed in claim 1, wherein the housing comprises an outside body half and an inside body half, each of the outside body half and the inside body half respectively has an internal recess and an outside, where the internal recess in the outside body half corresponds to the internal recess in the inside body half to form the internal body cavity that encases the roller within.

5. The hypocycloid drive device as claimed in claim 2, wherein three radial flanges are equidistantly formed on the exterior surface of the roller to divide the exterior surface of the roller into two respective parts to prevent the tilt cord from fouling on the roller; and a locking hole is defined through the exterior surface of the roller to hold the two ends of the tilt cord;

wherein a portion of the tilt cord wraps around each respective part of the exterior surface of the roller between two adjacent radial flanges.

6. The hypocycloid drive device as claimed in claim 3 further comprises a cord guide having two bottom openings pivotally mounted on the front of the housing where the two bottom openings respectively allow the two ends of the tilt cord to pass into the internal cavity of the housing to be attached to the locking hole on the roller.

7. The hypocycloid drive device as claimed in claim 5 further comprises a cord guide having two bottom openings pivotally mounted on the front of the housing where the two bottom openings respectively allow the two ends of the tilt cord to pass into the internal cavity of the housing to be attached to the locking hole on the roller.

* * * * *